US006798146B2

(12) United States Patent
Oota

(10) Patent No.: US 6,798,146 B2
(45) Date of Patent: Sep. 28, 2004

(54) DISPLAY APPARATUS AND METHOD OF DRIVING THE SAME

(75) Inventor: Tsutomu Oota, Saitama-Ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/354,033

(22) Filed: Jan. 30, 2003

(65) Prior Publication Data

US 2003/0142363 A1 Jul. 31, 2003

(30) Foreign Application Priority Data

Jan. 31, 2002 (JP) ..... 2002-024257

(51) Int. Cl.[7] ..... G09G 3/10

(52) U.S. Cl. ..... 315/169.1; 315/169.3; 315/169.4; 345/87; 345/204

(58) Field of Search ..... 315/169.3, 169.1, 315/169.4; 345/76–80, 60, 63, 87–90, 204, 690, 98, 209

(56) References Cited

U.S. PATENT DOCUMENTS 5,933,199 A * 8/1999 Yoon ..... 348/674
6,359,389 B1 * 3/2002 Medina et al. ..... 315/169.1
6,437,716 B2 * 8/2002 Nakao ..... 345/98
6,593,691 B2 * 7/2003 Nishi et al. ..... 315/169.3
6,633,271 B1 * 10/2003 Motegi et al. ..... 345/87

* cited by examiner

*Primary Examiner*—Don Wong
*Assistant Examiner*—Ephrem Alemu
(74) *Attorney, Agent, or Firm*—Oblon, Spivak, McClelland, Maier & Neustadt, P.C.

(57) ABSTRACT

A display including: signal lines and scanning lines which are arrayed; display pixels formed in vicinity of the signal lines and scanning lines; a gradation voltage generating circuit which generates gradation voltages for supplying to the signal lines by performing resistance division by a plurality of resistor elements with regard to two types of reference voltages; a γ correction voltage generating circuit which generates a voltage for γ correction applied to at least one of connection paths between the plurality of resistor elements; and a signal line voltage generating circuit which selects the gradation voltage in accordance with digital pixel data among the gradation voltages generated by the gradation voltage generating circuit and supplies the selected gradation voltage to the corresponding signal line.

20 Claims, 4 Drawing Sheets

DISPLAY APPARATUS AND METHOD OF DRIVING THE SAME

CROSS REFERENCE TO RELATED APPLICATIONS

This application is based upon and claims the benefit of priority from the prior Japanese Patent Applications No. 2002-24257, filed on Jan. 31, 2002, the entire contents of which are incorporated herein by reference.

BACKGROUND OF THE INVENTION

1. Field of the Invention

The present invention relates to a display apparatus for performing γ correction with regard to signal voltages applied to signal lines.

2. Related Background Art

Generally, plain display apparatus such as a liquid crystal display or organic EL (Electroluminescence) display performs display operation by supplying to signal lines voltages in accordance with brightness of pixels. However, the brightness of screen is not directly proportional to the voltages of the signal lines, but changes exponentially with regard to the voltages of the signal lines. For example, in the case of ordinary liquid crystal display, when the voltages of the signal lines are small, the brightness gradually changes. Because of this, as the voltages of the signal lines become larger, the brightness changes more rapidly.

Because each of the liquid crystal display has an inherent γ value, it is general to perform the γ correction for adjusting the brightness in accordance with the γ value.

Conventionally, the γ correction has been performed by adjusting amplitude of the common voltage applied to an opposite electrode. In the case of this method, according the adjustment, during a normal white (a mode of displaying maximum brightness at time when no voltage is applied), the problem with which black color is displayed as color including white color component, may occur, thereby deteriorating display quality.

SUMMARY OF THE INVENTION

An object of the present invention is to provide a display apparatus capable of performing γ correction at high accuracy.

In order to achieve the foregoing object,

According to the present invention, a display apparatus, comprising:

signal lines and scanning lines which are arrayed;

display pixels formed in vicinity of said signal lines and scanning lines;

a gradation voltage generating circuit which generates gradation voltages for supplying to said signal lines by performing resistance division by a plurality of resistor elements with regard to two types of reference voltages;

a γ correction voltage generating circuit which generates a voltage for γ correction applied to at least one of connection paths between said plurality of resistor elements; and a signal line voltage generating circuit which selects the gradation voltage in accordance with digital pixel data among the gradation voltages generated by said gradation voltage generating circuit and supplies the selected gradation voltage to the corresponding signal line.

DESCRIPTION OF THE PREFERRED EMBODIMENTS

Hereinafter, a display apparatus according to the present invention will be more specifically described with reference to drawings.

Figure 1:
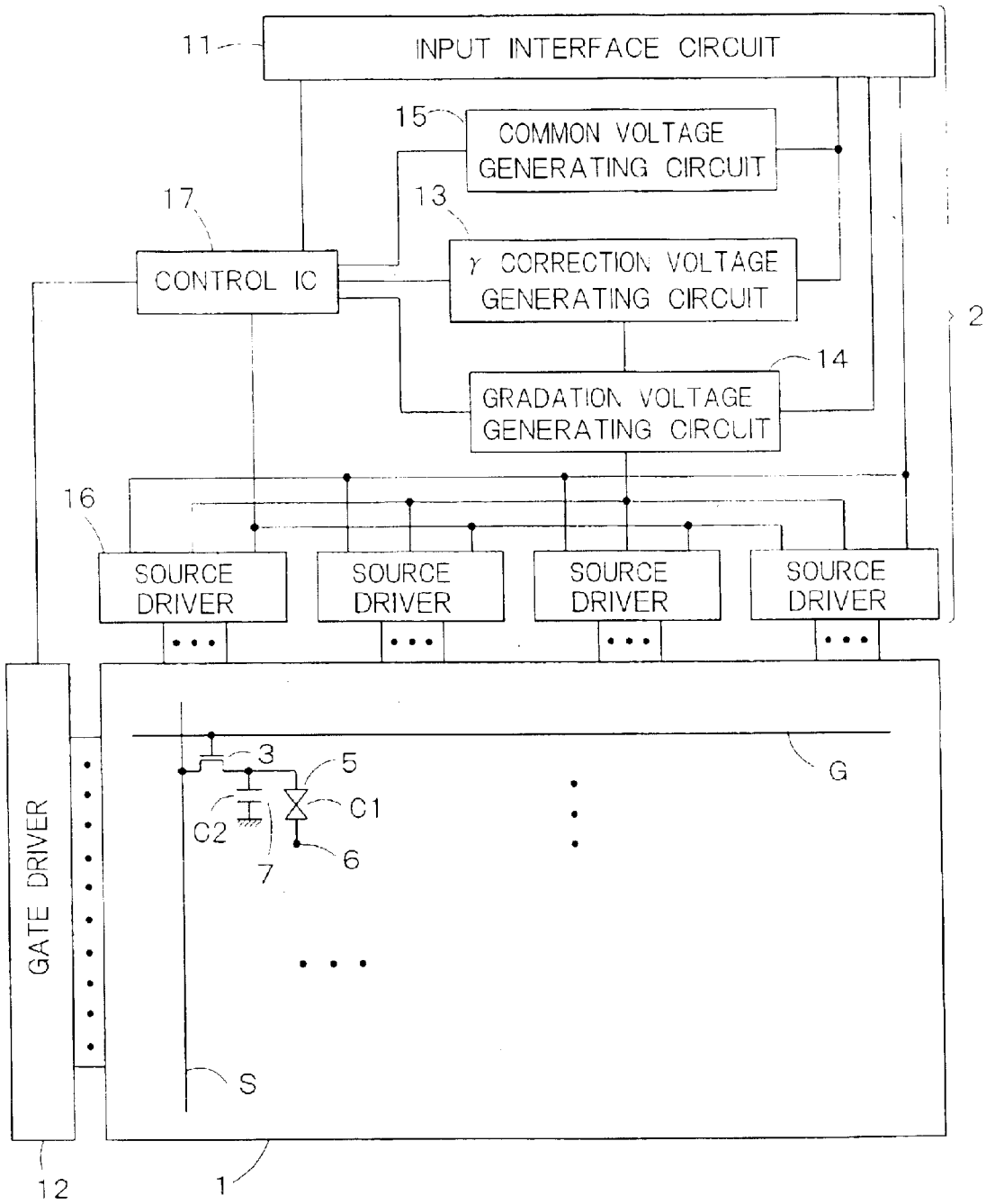
FIG. 1 is a diagram showing schematic configuration of one embodiment of a display apparatus according to the present invention.

FIG. 1 is a block diagram showing schematic configuration of an embodiment of a display apparatus according to the present invention, and shows configuration of a liquid crystal display.

The liquid crystal display of FIG. 1 is composed of a pixel array part 1 and a drive circuit part 2. The pixel array part 1 includes a plurality of signal lines S and scanning lines G arrayed on a glass substrate, pixel TFTs 3 formed in the vicinity of intersections of the signal lines S and the scanning lines G, pixel electrodes 5 connected to the pixel TFTs 3, liquid crystal capacitors C1 formed between the pixel electrodes 5 and an opposite electrode, and auxiliary capacitors C2 formed between the pixel electrodes 5 and an auxiliary capacitor electrode 7.

The drive circuit part 2 includes an input interface circuit 11 for importing synchronized signals, digital pixel data and soon from a host computer not shown, a gate driver 12 for controlling a gate voltage of the pixel TFT 3, a γ correction voltage generating circuit 13 for generating a γ correction voltage, a gradation voltage generating circuit 14 for generating gradation voltages, a common voltage generating circuit 15 for generating a common voltage Vcom applied to the opposite electrode 6, source drivers 16 which control the voltages of the signal lines and is connected to source electrodes of the respective pixel TFTs 3, and a control IC 17 for performing the entire control.

Each of a plurality of source drivers 16 is provided for every multiple signal lines of the pixel array part 1. For example, the source drivers 16 are formed of TCP (Tape Carrier Package). Gradation reference voltages V0–V9 outputted from the gradation voltage generating circuit 14 and the digital pixel data imported by the input interface circuit 11 are inputted to each source driver 16. Each source driver 16 generates the gradation voltage in accordance with the value of the digital pixel data based on the gradation reference voltages, and supplies the generated gradation voltage to the corresponding signal line.

Figure 2:
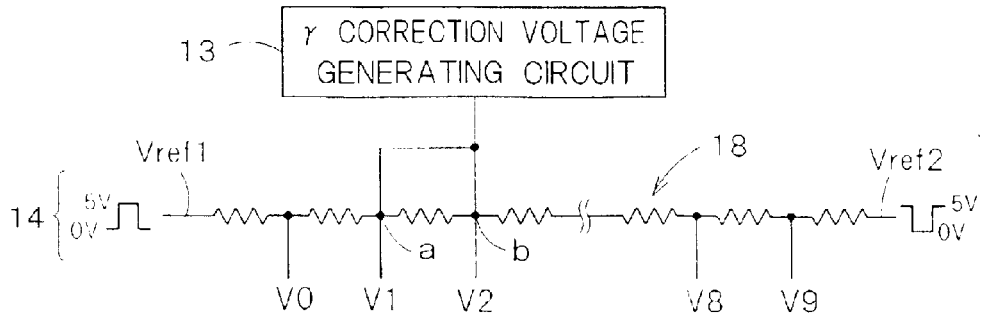
FIG. 2 is a circuit diagram showing internal configuration of a gradation voltage generating circuit.

FIG. 2 is a circuit diagram showing internal configuration of the gradation voltage generation circuit 14. As shown in FIG. 2, the gradation voltage generation circuit 14 has a resistor array 1 composed of a plurality of resistor elements connected in series. Reference voltages Vref1 and Vref2 inverting to each other (for example, one is 0V and the other is 5V) are supplied to both ends of the resistor array 18. The voltage level of the reference voltages Vref1 and Vref2 inverts for every prescribe horizontal lines such as each horizontal line or each frame, in order to prevent burning of liquid crystal or to reduce flicker.

The gradation voltages V0–V9 which are obtained by resistance division are outputted from interstages of a plurality of resistor elements connected in series. The gradation voltages V0–V9 have the voltage levels in accordance with resistance ratio of a plurality of resistor elements.

The γ correction voltage from the γ correction voltage generating circuit 13 is applied to at least one interstage among a plurality of resistor elements. FIG. 2 shows an example in which the γ correction voltages are applied to nodes a and b to output the gradation voltages V1 and V2.

Figure 3:
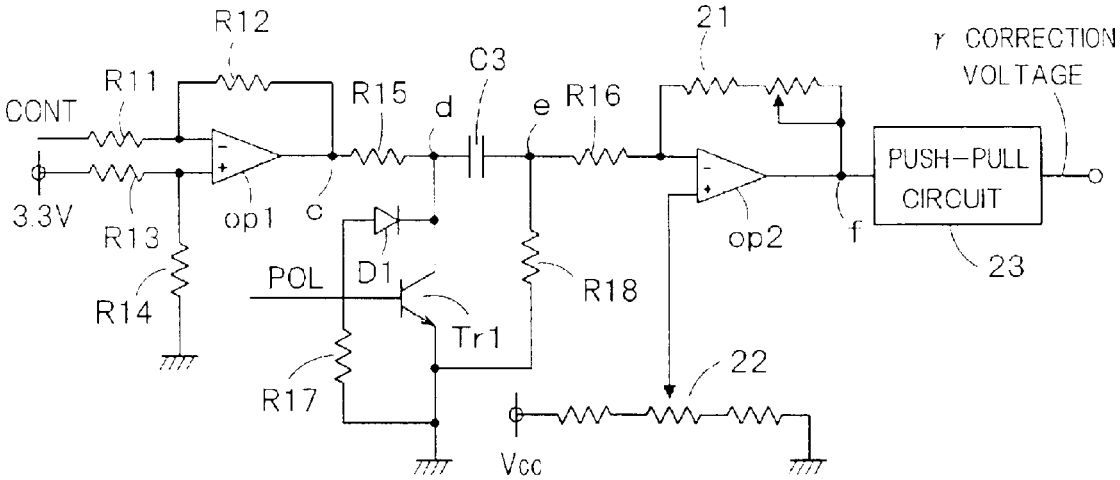
FIG. 3 is a circuit diagram showing one example of internal configuration of the γ correction voltage generating circuit.

FIG. 3 is a circuit diagram showing one example of internal configuration of the γ correction voltage generating circuit 13. The γ correction voltage generating circuit 13 of FIG. 3 has operational amplifiers op1 and op2, resistor elements R11 and R12 connected between an input terminal CONT and an output terminal of the operational amplifier op1, resistor elements R13 and R14 connected to a positive input terminal of the operational amplifier op1, a resistor R15, a capacitor C3 and a resistor element R16 connected in series between the output terminal of the operational amplifier op1 and a negative input terminal of the operational amplifier op2, a transistor Tr1, a diode D1 and resistor elements R17 and R18 for converting the output voltage of the operational amplifier op1 to a voltage in accordance with polarity POL, a resistance adjustment circuit 21 connected between the negative input terminal and the output terminal of the operational amplifier op2, a resistance adjustment circuit 22 connected to the positive input terminal of the operational amplifier op2, and a push-pull circuit 23 connected to the output terminal of the operational amplifier op2. The same voltage as an external power supply voltage Vcc supplied to the common voltage generating circuit 15 is applied to the resistance adjustment circuit 22.

Figure 4:
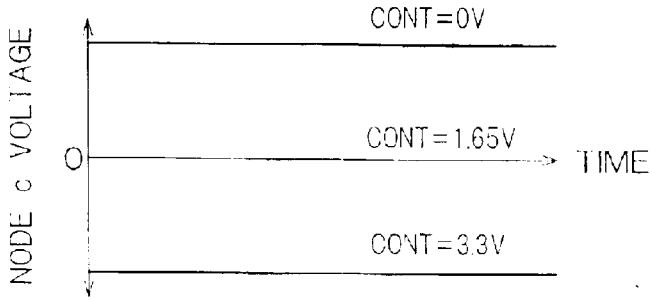
FIG. 4 is a diagram showing voltage waveform at node c.
Figure 5:
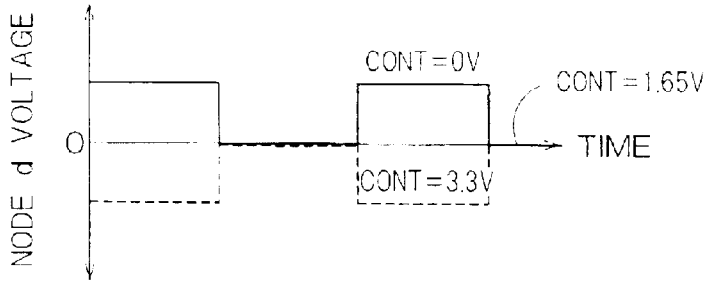
FIG. 5 is a diagram showing voltage waveform at node d.
Figure 6:
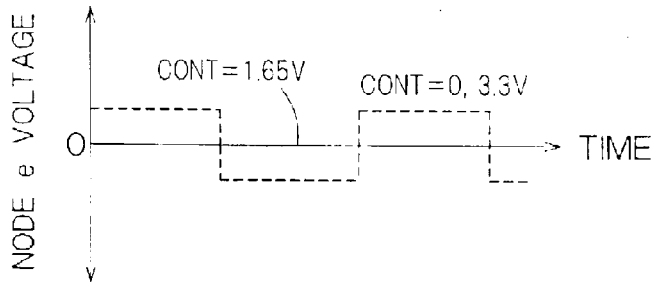
FIG. 6 is a diagram showing voltage waveform at node e.
Figure 7:
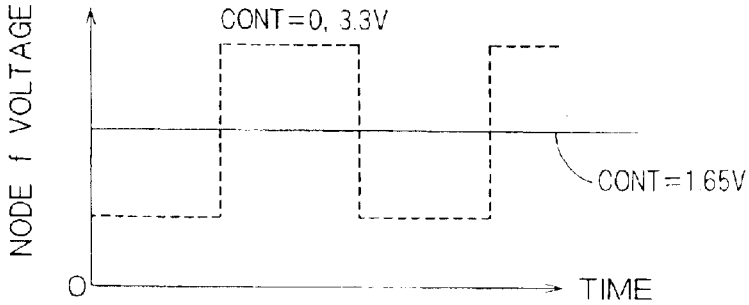
FIG. 7 is a diagram showing voltage waveform at node f.

In the circuit of FIG. 3, a DC voltage within 0–3.3 V within 0–3.3V is applied to the input terminal CONT. The output voltage (node c) of the operational amplifier op1 becomes the DC voltage decided by the input terminal CONT as shown in FIG. 4. The nodes d and e at both ends of the capacitor C3 becomes voltages with rectangle waveform changing by the polarity signal POL, as shown in FIGS. 5 and 6. The output voltage (node f) of the operational amplifier op2 becomes the same voltage in both cases where the input terminal CONT is 0V and 3.3V, as shown in FIG. 7, and becomes the DC voltage which is not dependent on the polarity signal POL when the input electrode CONT is 1.65V.

An external voltage for generating the common voltage supplied to the common voltage generating circuit 15 is applied to the input terminal CONT. That is, the γ correction voltage generating circuit 13 generates the γ correction voltage by using the external voltage for generating the common voltage supplied to the common voltage generating circuit. Because of this, it is unnecessary to provide a dedicated power supply voltage for generating the γ correction voltage, thereby simplifying circuit configuration.

As shown in FIGS. 4–7, the γ correction voltage outputted from the γ correction voltage generating circuit 13 is a voltage changing in accordance with the voltage applied to the input terminal CONT. They correction voltage is applied to interstages of a plurality of resistor elements in the gradation voltage generating circuit 14, for example, nodes a and b of FIG. 2. Therefore, it is possible to separately adjust the voltage level of the gradation voltages outputted from a plurality of resistor elements.

Figure 8:
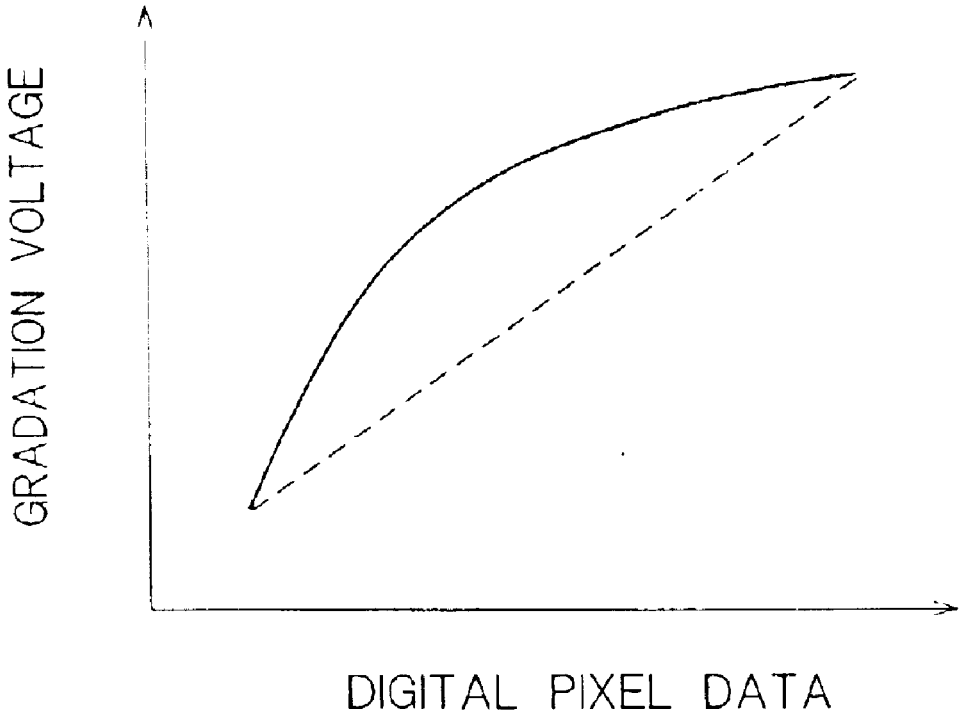
FIG. 8 is a diagram showing a relationship between values of digital pixel data and gradation voltages.

FIG. 8 is a diagram showing a relationship between values of the digital pixel data and the gradation voltages. In the case of this embodiment, instead of linear property as shown in a dotted-line, non-linear property as shown in a solid line is obtained. Therefore, it is possible to improve display property at gray color level.

In FIG. 2, an example in which the γ correction voltage is applied to nodes a and b has been explained. However, the location for applying the γ correction voltage is not limited. In practice, it is desirable to decide the location for applying the γ correction voltage in accordance with the properties of each liquid crystal display.

Thus, according to this embodiment, because the γ correction voltage is applied to at least one of the interstages of a plurality of resistor elements in the gradation voltage generating circuit 14, it is possible to perform γ correction at higher accuracy in accordance with the γ value of each liquid crystal display. Because of this, even if there is dispersion of the γ value for each liquid crystal display, the influence of the dispersion is avoided by controlling the location for applying the γ correction voltage and the voltage level of the γ correction voltage.

In the above-mentioned embodiment, the example in which the γ correction voltage generating circuit 13 and the gradation voltage generating circuit 14 are provided separate from the source driver 16, has been explained. However, at least one of the γ correction voltage generating circuit 13 and the gradation voltage generating circuit 14 may be provided inside the source driver 16.

In the above-mentioned embodiment, an example in which the display apparatus according to the present invention is applied to the liquid crystal display, has been explained. However, the present invention is also applicable to the other type display apparatuses for driving the arrayed signal lines, such as a plasma display or EL display.

What is claimed is:

1. A display apparatus, comprising:

signal lines and scanning lines which are arrayed;

display pixels formed in vicinity of said signal lines and scanning lines;

a gradation voltage generating circuit which generates gradation voltages for supplying to said signal lines by performing resistance division by a plurality of resistor elements with regard to two types of reference voltages;

a γ correction voltage generating circuit which generates a voltage for γ correction applied to at least one of connection paths between said plurality of resistor elements; and a signal line voltage generating circuit which selects the gradation voltage in accordance with digital pixel data among the gradation voltages generated by said gradation voltage generating circuit and supplies the selected gradation voltage to the corresponding signal line.

2. The display apparatus according to claim 1, wherein said plurality of resistor elements are connected in series, and said voltage for γ correction is applied to at least one of connection paths among the connection paths between said resistor elements arranged adjacently.

3. The display apparatus according to claim 1, wherein said plurality of resistor elements are connected in series, and said voltage for γ correction is applied to at least two connection paths among the connection paths between said resistor elements arranged adjacently; and said γ correction voltage generating circuit separately controls voltage level of said voltage for γ correction applied to said at least two respective connection paths.

4. The display apparatus according to claim 1, wherein said voltage for γ correction is set to voltage level at which the digital pixel data and the gradation voltages become non-linear relationship.

5. The display apparatus according to claim 1, wherein said γ correction voltage generating circuit generates said voltage for γ correction with voltage level in accordance with an input control signal and a polarity signal.

6. The display apparatus according to claim 5, wherein said input control signal has voltage level between said two types of reference voltages supplied to said gradation voltage generating circuit.

7. The display apparatus according to claim 5, wherein said input control signal is one among multiple types of DC voltage signals set in advance.

8. The display apparatus according to claim 5, wherein a voltage of opposite electrodes arranged opposite is set based on said input control signal.

9. A display apparatus, comprising:

a pixel array substrate; and an opposite substrate arranged opposite to said pixel array substrate, on which an opposite electrode is formed, wherein said pixel array substrate includes:

signal lines and scanning lines which are arrayed;

display pixels formed in vicinity of said signal lines and scanning lines;

a gradation voltage generating circuit which generates gradation voltages for supplying to said signal lines by performing resistance division by a plurality of resistor elements with regard to two types of reference voltages;

a γ correction voltage generating circuit which generates a voltage for γ correction applied to at least one of connection paths between said plurality of resistor elements; and a signal line voltage generating circuit which selects the gradation voltage in accordance with digital pixel data among the gradation voltages generated by said gradation voltage generating circuit and supplies the selected gradation voltage to the corresponding signal line.

10. The display apparatus according to claim 9, wherein said plurality of resistor elements are connected in series, and said voltage for γ correction is applied to at least one of connection paths among the connection paths between said resistor elements arranged adjacently.

11. The display apparatus according to claim 9, wherein said plurality of resistor elements are connected in series, and said voltage for γ correction is applied to at least two connection paths among the connection paths between said resistor elements arranged adjacently; and said γ correction voltage generating circuit separately controls voltage level of said voltage for γ correction applied to said at least two respective connection paths.

12. The display apparatus according to claim 9, wherein said voltage for γ correction is set to voltage level at which the digital pixel data and the gradation voltages become non-linear relationship.

13. The display apparatus according to claim 9, wherein said γ correction voltage generating circuit generates said voltage for γ correction with voltage level in accordance with a input control signal and a polarity signal.

14. The display apparatus according to claim 9, wherein said input control signal has voltage level between said two types of reference voltages supplied to said gradation voltage generating circuit.

15. The display apparatus according to claim 14, wherein said input control signal is one among multiple types of DC voltage signals set in advance.

16. The display apparatus according to claim 14, wherein a voltage of opposite electrodes arranged opposite is set based on said input control signal.

17. A driving method of a display apparatus comprising signal lines and scanning lines which are arrayed, and display pixels formed in vicinity of intersections of said signal lines and said scanning lines, comprising:

generating gradation voltages for supplying to said signal lines by performing resistance division by a plurality of resistor elements with regard to two types of reference voltages;

generating a voltage for γ correction applied to at least one connection path between said plurality of resistor elements; and selecting the gradation voltage in accordance with digital pixel data among the generated gradation voltages, and supplying the selected gradation voltage to the corresponding signal line.

18. The driving method of a display apparatus according to claim 17, wherein said plurality of resistor elements are connected in series, and said voltage of γ correction is applied to at least one of connection paths among the connection paths between said resistor elements arranged adjacently.

19. The driving method of a display apparatus according to claim 17, wherein said plurality of resistor elements are connected in series, and said voltage of γ correction is applied to at least two of the connection paths; and said γ correction voltage generating circuit separately controls the voltage level of said voltage of γ correction applied to each of said at least two of the connection paths.

20. The driving method of a display apparatus according to claim 17, wherein a voltage of an opposite electrode arranged opposite to said display apparatus is set based on said input control signal.

* * * * *